US006058548A

United States Patent [19]

Footer et al.

[11] Patent Number: 6,058,548

[45] Date of Patent: May 9, 2000

[54] REMOVABLE CLEANING ELEMENT FROM MOP

[75] Inventors: Harold Footer, Newton; Alan D. Ball, Arlington, both of Mass.; Timothy J. Coonahan, Londonderry, N.H.; Philip C. Walker, Arlington; David G. Honan, Concord, both of Mass.

[73] Assignee: Easy Day Manufacturing Company, Holliston, Mass.

[21] Appl. No.: 09/067,281

[22] Filed: Apr. 27, 1998

[51] Int. Cl.[7] ..... A47L 13/24

[52] U.S. Cl. ..... 15/119.2; 15/121; 15/228; 15/244.1

[58] Field of Search ..... 15/119.1, 119.2, 15/116.1, 116.2, 121, 228, 244.1, 244.2; D32/50

[56] References Cited

U.S. PATENT DOCUMENTS

| | | |
|---|---|---|
| D. 327,146 | 6/1992 | Miller . |
| 947,145 | 1/1910 | Ax . |
| 2,534,086 | 12/1950 | Vosbikian et al. . |
| 2,677,837 | 5/1954 | Channell . |
| 2,678,458 | 5/1954 | Vosbikian et al. . |
| 2,715,745 | 8/1955 | Jacobsen . |
| 2,741,788 | 4/1956 | Shey . |
| 3,631,561 | 1/1972 | Aszkenas . |
| 3,721,502 | 3/1973 | Ognibene . |
| 3,968,535 | 7/1976 | Nichols, Jr. . |
| 3,991,431 | 11/1976 | Thielen . |
| 4,124,915 | 11/1978 | Schlicher . |
| 4,312,093 | 1/1982 | Raab . |
| 4,315,342 | 2/1982 | Ash . |
| 4,381,575 | 5/1983 | Wendt . |
| 4,409,700 | 10/1983 | Sullivan . |
| 4,509,224 | 4/1985 | Batchelor . |
| 4,607,411 | 8/1986 | Lewis, Jr. . |
| 4,785,489 | 11/1988 | VonDoehren . |
| 4,831,677 | 5/1989 | Morrison et al. . |
| 4,864,675 | 9/1989 | Jones . |
| 4,893,370 | 1/1990 | Klotz . |
| 4,910,825 | 3/1990 | Mauer . |
| 5,138,736 | 8/1992 | Pesa . |
| 5,371,917 | 12/1994 | Hoagland . |
| 5,429,678 | 7/1995 | Fany . |
| 5,469,594 | 11/1995 | Nolte . |
| 5,515,570 | 5/1996 | Muscroft . |
| 5,539,949 | 7/1996 | Stanton . |
| 5,575,032 | 11/1996 | Cernuska . |
| 5,615,449 | 4/1997 | Sepke . |
| 5,836,039 | 11/1998 | Rimer ..... 15/228 |

OTHER PUBLICATIONS

Mechanical Sponge Mop Squeezing Device, M.K. Project, Product Literature, Jan. 25, 1997.

*Primary Examiner*—Robert J. Warden, Sr.
*Assistant Examiner*—Jennifer C. McNeil
*Attorney, Agent, or Firm*—Wolf, Greenfield & Sacks, P.C.

[57] ABSTRACT

A backing plate that removably attaches a sponge to a mop head includes a top surface, that removably attaches to the mop head, and a bottom surface, to which the sponge is attached. At least one male attachment member is located on the first edge of the top surface of the backing plate, for removable attachment to a corresponding female member on the mop head. At least one female attachment member is located on a second edge of the top surface of the backing plate, for removable attachment to a corresponding male member on the mop head. In the preferred embodiment, each male attachment member on the backing plate includes a lip and each female attachment member on the backing plate includes a C-shaped member.

5 Claims, 6 Drawing Sheets

102
104
100
106
108
110
120
145
117
143A
112
116
114
141
143B
129
118
147B
122
135A
135B
127
113
115
133C
137
131A
128
124
127B
125A
131B
125B
126
127A
133A
125C
133B
125D

REMOVABLE CLEANING ELEMENT FROM MOP

FIELD OF THE INVENTION

The present invention relates to a replaceable floor cleaning element (sponge) for a mop. The invention relates more specifically to a backing plate, removably attached to a mop head, to which a sponge is attached.

BACKGROUND OF THE INVENTION

Mops are floor cleaning implements which include a cleaning element, attached to an elongate handle, that contacts the floor during cleaning and that absorbs (and expels) a liquid. A floor cleaning element may be a sponge, a piece of cloth, string elements or the like. The floor cleaning element typically is used to expel liquid during cleaning of the floor surface and to absorb liquid during drying of the surface. There exist many different mop designs, including those which have a wringing element for wringing liquid from the floor cleaning element.

Through use, floor cleaning elements of mops wear and become unusable. Their absorption and expulsion capacities reduce greatly through use. As a result, some mops are designed to be disposable, such mops being disposed of after the floor cleaning element becomes unusable. In such disposable mops, the remaining elements of the mop (i.e., the handle, the mop head, etc.) typically are still in fine operating shape when the mop is disposed.

To overcome the wasteful nature of disposable mops, some mops offer replaceable floor cleaning elements, i.e., replaceable sponges. The floor cleaning element is replaced on the mop when worn. None of such mops to date offers a satisfactory design for easily replacing the floor cleaning element while still providing for effective cleaning. In some designs, replacing the sponge requires removal and then replacement of hardware with a tool, which may be burdensome and difficult. In many mop designs, once the floor cleaning element has been replaced, it becomes loose and slips during use, greatly reducing its effectiveness.

SUMMARY OF THE INVENTION

One embodiment of the present invention is directed to a mop including an elongate handle. A mop head is attached to one end of the handle. A backing plate, to which a floor cleaning element is attached, is removably attached to the mop head. The backing plate includes a male attachment member on a first edge thereof and a female attachment member on a second edge thereof. The male attachment member on the backing plate removably attaches to a female member on the mop head and the female attachment member on the backing plate attaches to a male member on the mop head.

In an embodiment of the invention, the backing plate includes at least one lip on the first edge of the backing plate, each of which at least one lip is removably inserted into a corresponding slot in the mop head.

In an embodiment, the backing plate also includes at least one C-shaped member on a second edge of the backing plate, each of which C-shaped member is removably wrapped about a corresponding shoulder on the mop head.

In one embodiment, the first edge is a forward edge and the second edge is a rearward edge.

In an embodiment, an upper surface of the backing plate includes protrusions that fit within corresponding compartments on an underneath surface of the mop head. In an embodiment, the protrusions are T-shaped.

In an embodiment, the backing plate includes two side members connected by a plurality of spaced, flexible finger members. In an embodiment, the side members may flex about the fingers toward one another during wringing of the cleaning element.

In an embodiment, the mop further includes a squeegee attached to the mop head.

Another embodiment of the present invention is directed to a plate that removably attaches a sponge to a mop head. The plate includes a top surface, that removably attaches to the mop head, and a bottom surface, to which the sponge is attached. The plate also includes at least one male attachment member on a first edge of the top surface, for removable attachment to a corresponding female member on the mop head. The plate also includes at least one female attachment member on the second edge of the top surface, for removable attachment to a corresponding male member on the mop head.

In one embodiment, each male attachment member on the backing plate includes a lip. In an embodiment, the first edge includes a forward edge.

In an embodiment, each female attachment member on the backing plate includes a C-shaped member. In an embodiment, the second edge includes a rearward edge.

In an embodiment, the plate further includes a plurality of protrusions on the top surface, that removably fit within corresponding compartments on an underneath surface of the mop head. In an embodiment, each protrusion is T-shaped.

In an embodiment, the backing plate includes two-side members connected by plurality of flexible, spaced finger members.

The features and advantages of the present invention will be more readily understood and apparent from the following detailed description of the invention, which should be read in conjunction with the accompanying drawings and from the claims which are appended to the end of the detailed description.

BRIEF DESCRIPTION OF THE DRAWING

For a better understanding of the present invention, reference is made to the accompanying drawings, which are incorporated herein by reference.

DETAILED DESCRIPTION

The present invention relates to a replaceable floor cleaning element for a mop. In a preferred embodiment, the invention is directed to a backing plate, removably attached to a mop head, to which a sponge is attached.

The backing plate of the present invention may be used with any type of mop, whether with or without a sponge wringing mechanism, with or without a squeegee, etc. One exemplary mop, with which the backing plate of the present invention may be used, is a mop, referred to as a "butterfly mop", that includes a sponge wringing mechanism, as well as a squeegee. The backing plate of the present invention will be described for use with such a mop. The invention is not limited, however, to use with the particular mop described.

Figure 1:
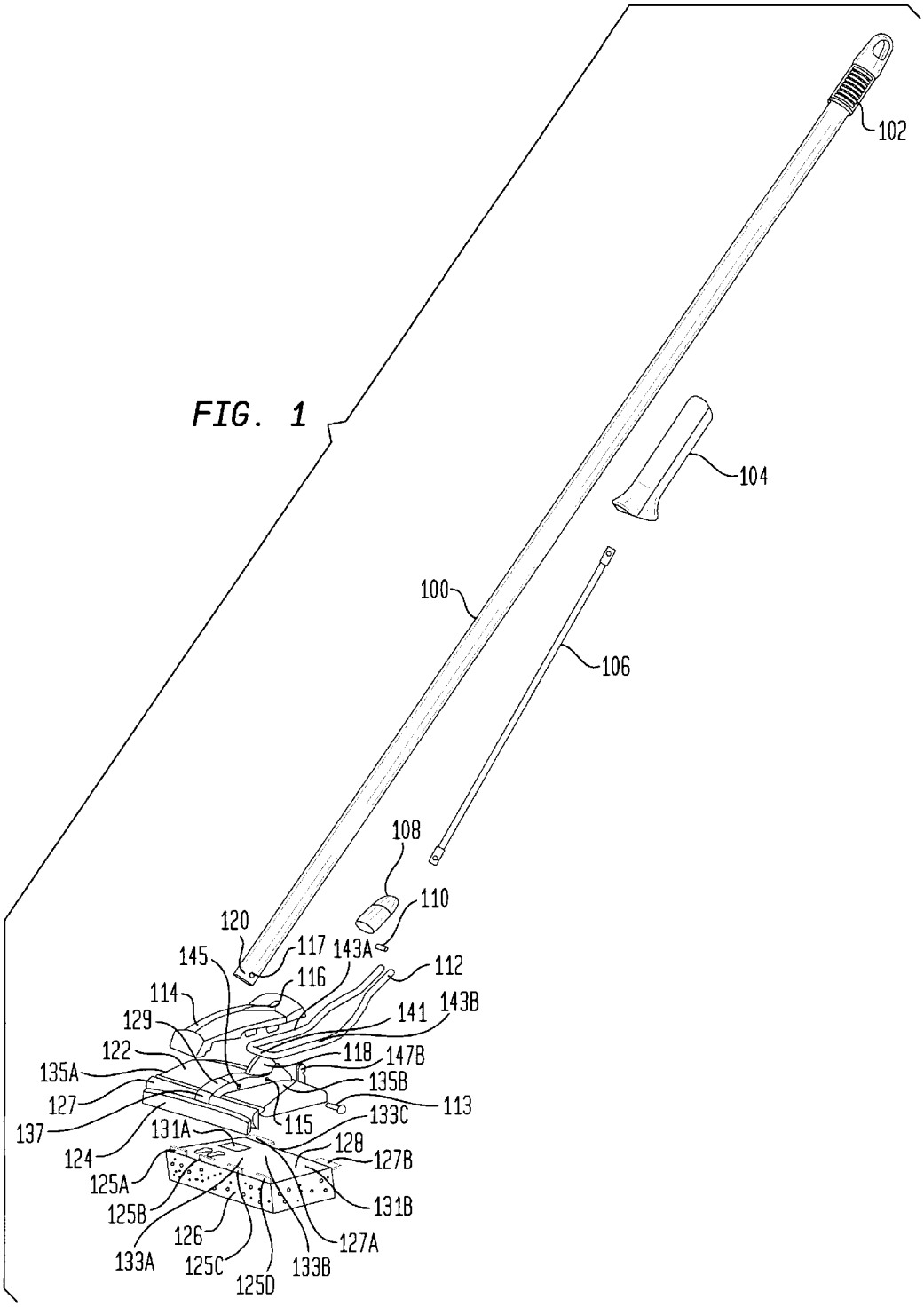
FIG. 1 is an exploded view of the butterfly mop including the backing plate according to the present invention.

As shown in FIG. 1, the butterfly mop includes a handle 100 and mop head 122. Handle 100 includes a proximal end having a grip 102 attached thereto, and a distal end 120, to which mop head 122 is attached. Grip 102 may be any conventional grip attached to the proximal end of handle 100. Distal end 120 of handle 100 is inserted into an opening within upwardly extending necks 118. A pin 113 is inserted through opening 115 within neck 118, and also through opening 117 within distal end 120 of handle 100, to retain mop head 122 on distal end of handle 100. As better shown in FIG. 3, sponge 126 is attached directly to backing plate 128, which in turn is removably attached to underneath side of mop head 122. Backing plate 128 may be essentially flat on an underneath side, to which sponge 126 is attached. The underneath side may alternatively include ridges or treads. Sponge 126 may be attached to backing plate 128 by any conventional means such as adhesive.

Backing plate 128 includes two side hinges 131A and 131B connected by three curved, relatively narrow, spaced attaching fingers 133A, 133B and 133C. Narrow attaching fingers 133A–133B may flex such that each hinge 131A and 131B moves downwardly toward the other when the sponge is to be wrung, as will be explained in greater detail below.

Figure 3:
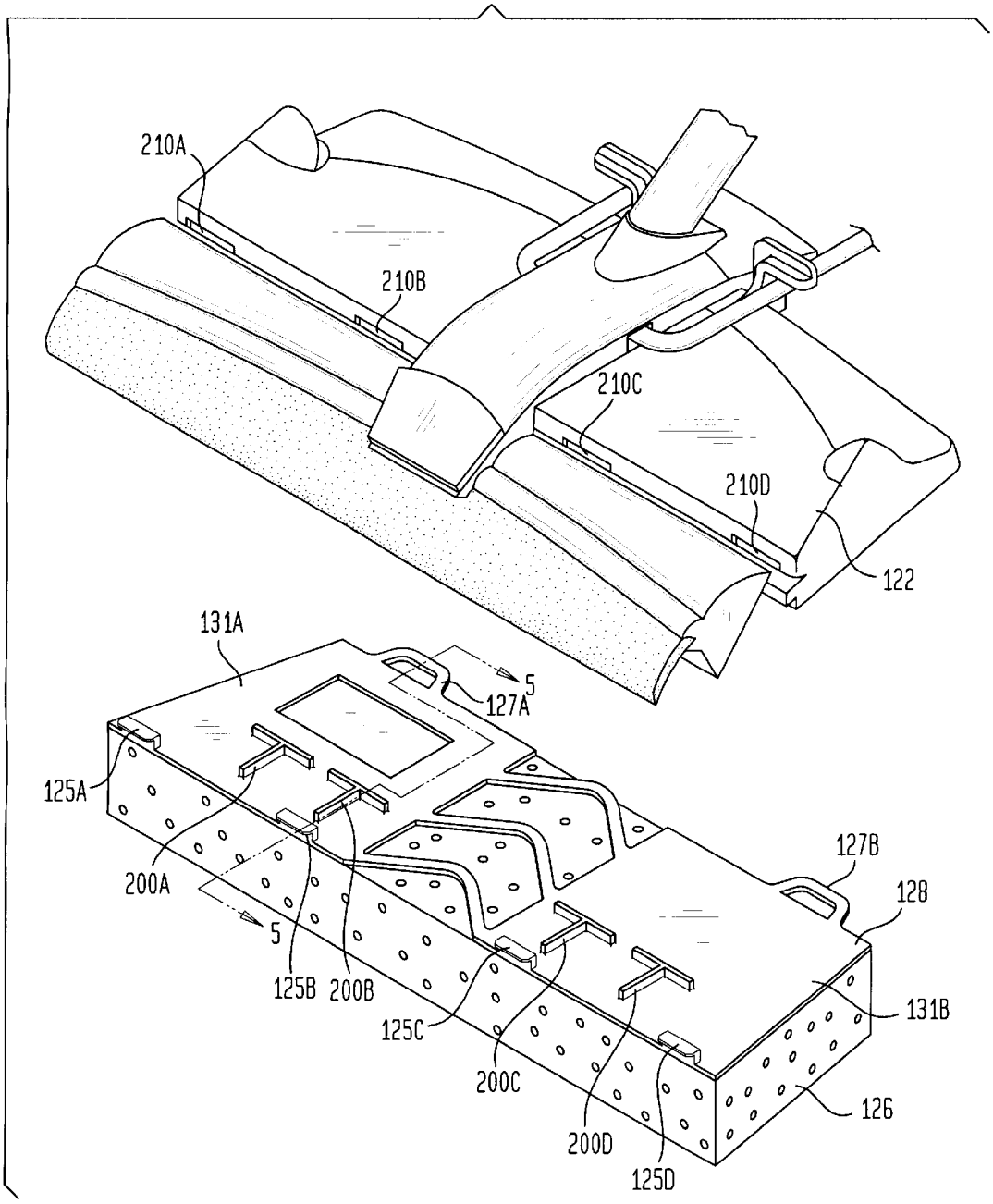
FIG. 3 is an exploded view of the mop of FIG. 1, better illustrating the backing plate according to the present invention.
Figure 4:
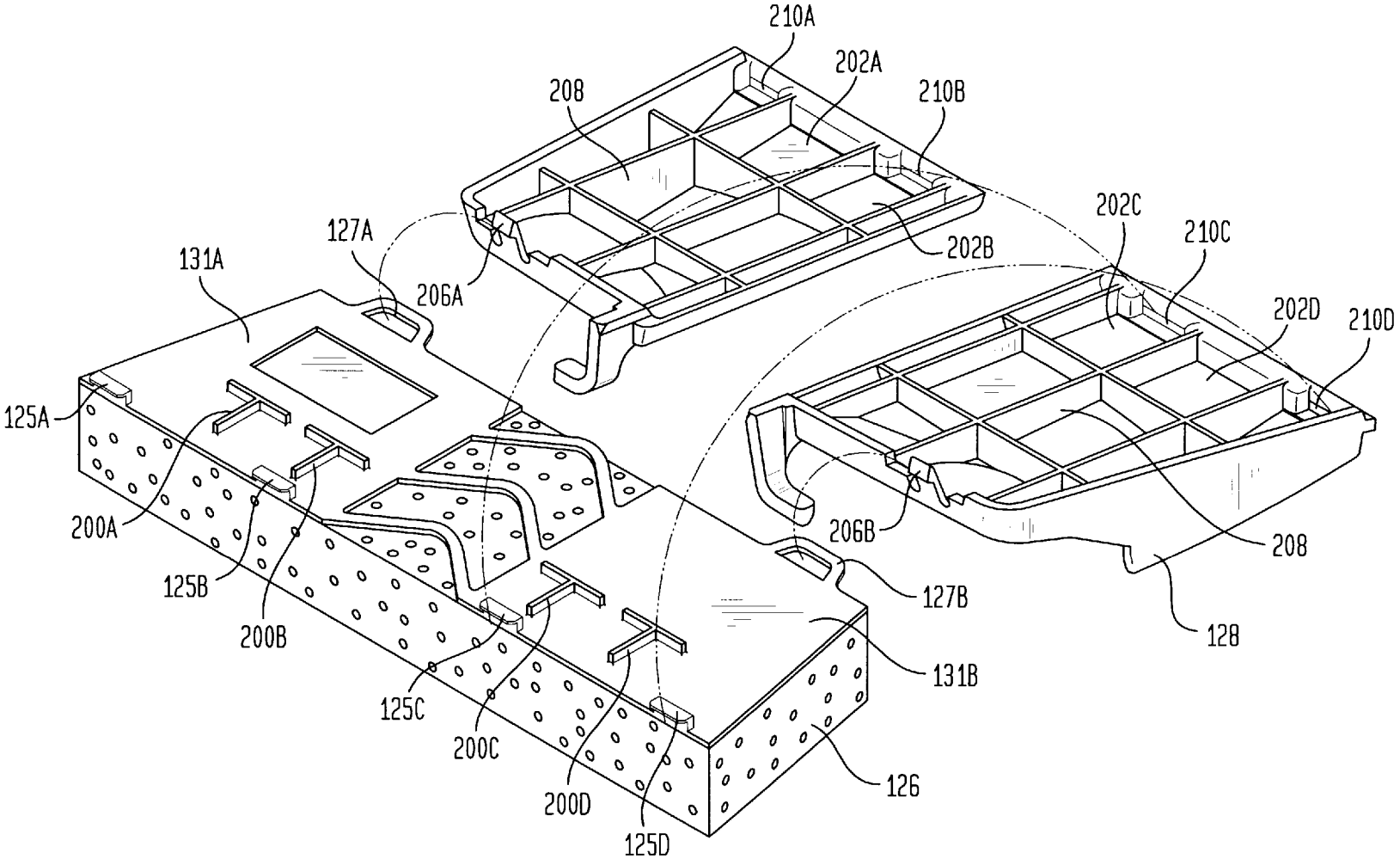
FIG. 4 illustrates how the backing plate of the present invention attaches to a mop head.
Figure 5:
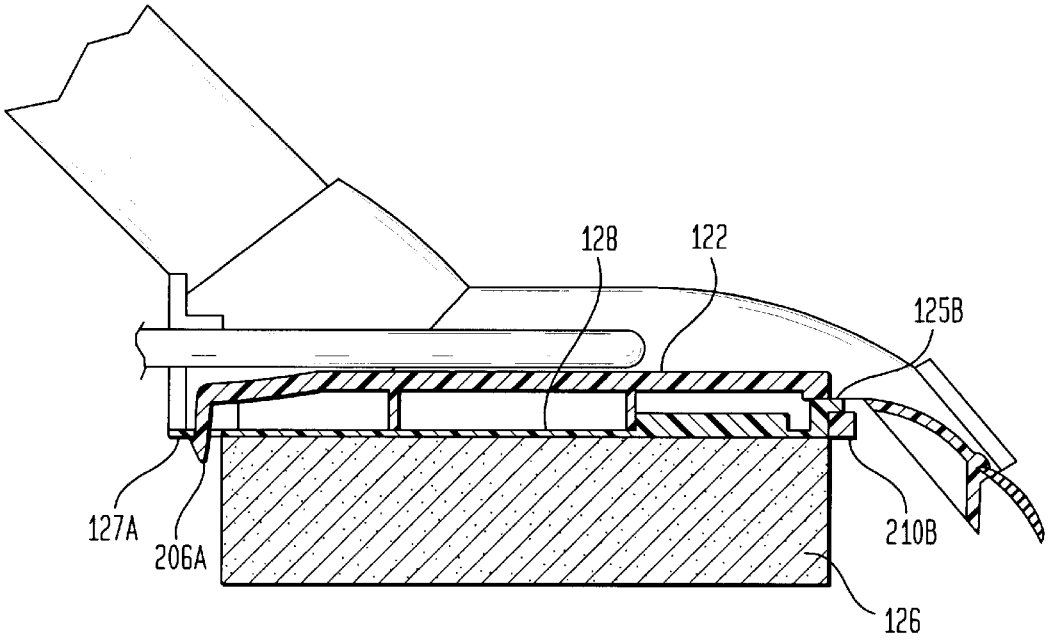
FIG. 5 is a cross-sectional view of the mop head taken along lines 5—5 of FIG. 1 with the attached backing plate according to the present invention.

The top surface of each hinge 131A and 131B, as better shown in FIGS. 3 and 4, includes two upwardly extending T-shaped members 200A–200D, each of which respectively fits within a corresponding compartment 202A–202D formed by downwardly extending protrusions 208 on the underneath surface of mop head 122. Each T-shaped member fits snugly within the corresponding compartment on the underneath side of the mop head for proper placement of the backing plate to the mop head. It also provides for tight retention of the backing plate to the mop head, enabling use and reuse of the mop without slippage of the sponge. The number, size, and shape of the protrusions and corresponding compartments is exemplary and not limiting. For removable attachment of backing plate 128 to mop head 122, a forward facing edge of backing plate 128 includes four L-shaped lip members 125A, 125B, 125C and 125D. The L-shaped lip members extend upwardly and forwardly from a forward edge of upper surface of backing plate 128. Each of lips 125A–125D extends into a corresponding slot 210A–210D on forward facing surface (behind the squeegee) of mop head 122 for aiding in removably retaining backing plate 128 to mop head 122. The number, shape and size of the lip members and the slots are exemplary. Backing plate 128 also includes two C-shaped members 127A and 127B, attached to a rearward edge of upper surface of backing plate 128, one 127A and 127B on each hinge 131A and 131B, respectively. Each C-shaped member extends rearwardly from the rearward edge of plate 128 such that an opening is located between the rearward edge and the C-shaped member. Each C-shaped member 127A, 127B is placed over a corresponding shoulder 206A, 206B that extends downwardly from a rearward facing surface of mop head 122, such that the shoulder extends within the opening of the C-shaped member.

The positioning of lips 125A–25D on forward edge of backing plate 128 within corresponding slots 210A–210D in the forward facing surface of mop head 122 and the positioning of downwardly extending shoulders from a rearward facing surface of mop head 122 into C-shaped 127A and 127B members on rearward edge of backing plate 128, retains the backing plate, and thereby the sponge, onto an underneath surface of mop head 122. The spacing between the lips 125A–125D and C-shaped members 127A and 127B (i.e., the distance from the front to rear edges of the backing plate) is approximately equal to the distance between the slots on the forward facing surface of mop head 122 and the shoulders on the rearward facing surface of mop head 122, such that backing plate 128 is retained tightly on mop head 122. To remove backing plate, and thereby sponge 126, from mop head 122, the C-shaped members 127A and 127B are pulled rearwardly and then are removed from the downwardly extending shoulders of mop head 122, enabling the lips 125A–125D to be removed from the forward facing slots of mop head 122.

The backing plate preferably is formed from a material which has sufficient strength to endure mopping yet it is somewhat flexible and elastic to enable wringing of a sponge (in a mop design that requires such wringing). The backing plate should be bendable and yet return to its at rest state without degrading its strength. One material from which the backing plate may be made includes polypropylene.

The lips on the forward edge of upper surface the backing plate may be referred to as male attachment members and the corresponding slots in the mop head may be referred to as female attachment members. Similarly, the C-shaped members on a rearward edge of upper surface of the backing plate may be referred to as female attachment members and the corresponding shoulders on the mop head may be referred to as male attachment members. The type of male and female attachment members shown herein, and the placing of male attachment members on a front edge of the backing plate and female attachment members on the rear edge of the backing plate, are exemplary. The type, number, placement and gender of the attachment members may be altered. Additionally, other attachment members are envisioned, provided the backing plate is snugly attached so that the cleaning element of the mop is retained well on the mop head for proper operation, and yet is easily removable from the mop head.

The exemplary mop head 122, shown and described herein, is formed with an upwardly extending central channel 129 from which collar 118 extends. On either side of central column 129 is located two relatively flat hinges 135A and 135B. While hinges 135A and 135B are formed integrally with collar 129, a crease exists between each of hinges 135A and 135B and collar 129 such that each of the hinges 135A and 135B may flex downwardly toward the sponge from collar 129 during wringing of the sponge, as will be explained in greater detail below.

Longitudinal squeegee receiving element 127 is formed integral with mop head 122 at a central location 137 of a squeegee receiving element 127. Column 129 of mop head 122 is coextensive with central location 137 of squeegee receiving element 127. Either side of central location 137 of squeegee receiving element 127 is spaced from a front surface of a mop head 122. The space enables the hinges 135A and 135B of mop head 122 to flex with respect to column 129 and with respect to squeegee receiving element 127.

Figure 2:
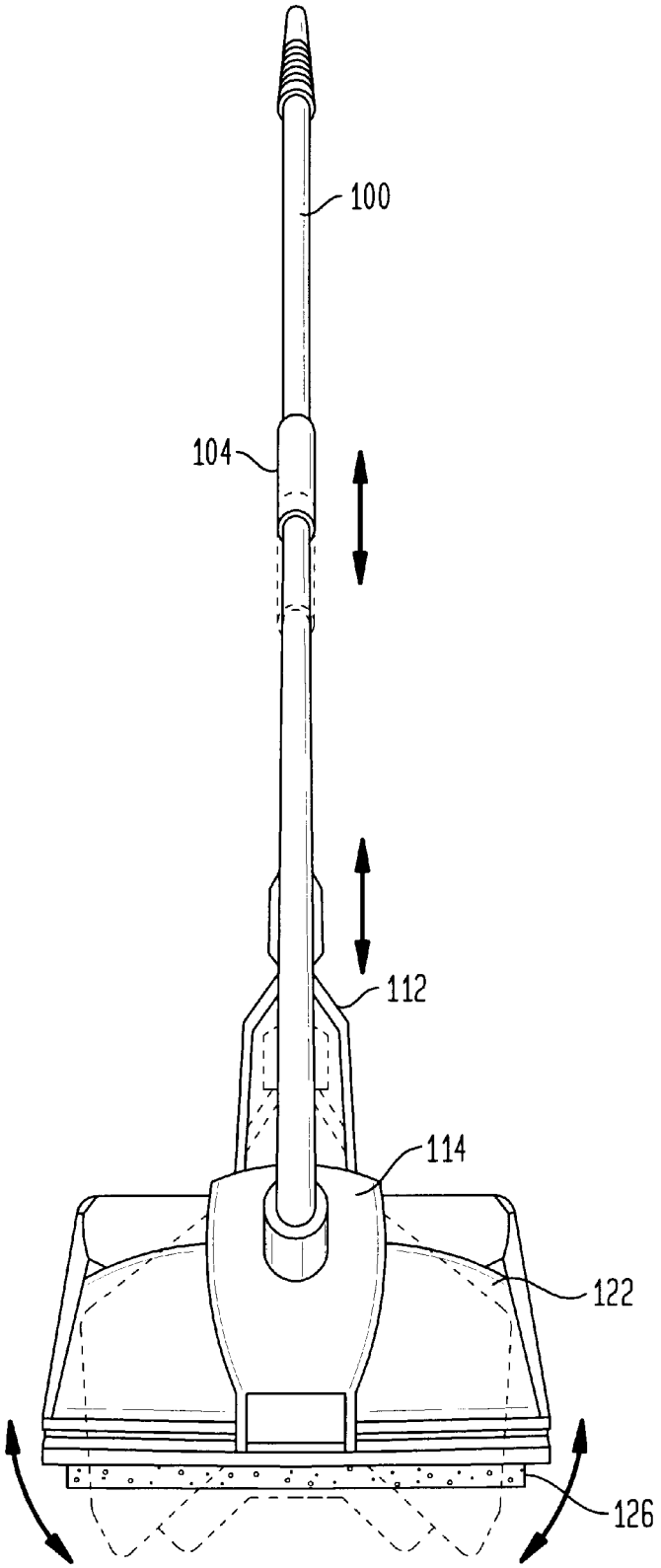
FIG. 2 illustrates the mop of FIG. 1 being wrung out.

Squeegee 124 is formed integrally with, or alternatively is affixed to, a forward facing portion of squeegee receiving element 127. An upper portion of squeegee 124 is located within a shoulder receiving portion 139 of squeegee receiving element 127. Squeegee 124 may be attached adhesively within shoulder 139 to squeegee receiving element 127. Alternatively, as noted, squeegee 124 may be formed integrally with squeegee receiving element 127. Mop head 122 is formed of a flexible yet strong material, which also has elastic qualities such that it may flex and return to its at rest position, such as polypropylene. The entire mop head 122, including co-extensive squeegee receiving portion 127, may be formed of a single piece of molded plastic. The wringing mechanism consists of a handle 104, a rod 106, a collar 108, a pin 110 and a bracket 112. Handle 104 is hollow and is placed about elongate handle 100 of the mop. Handle 104 may slide back and forth along handle 100 of the mop. A proximal end of rod 106 is attached to handle 104 by a pin (not shown). To distal end of rod 106 is attached bracket 112 by pin 110. A joint is formed at the connection of rod 106 to bracket 112 such that as handle 104 is slid downwardly along elongate handle 100 of mop toward the distal end thereof, bracket 112 is pushed downwardly. Collar 108 covers the joint connection between rod 106 and bracket 112. Bracket 112 has a U-shaped distal section which abuts against an upper surface of mop head 122. Sides 143A and 143B of U-shaped section 141 of bracket 112 respectively abut against hinges 135A and 135B. End portion of U-shaped distal section 141 extends through hole 145 of collar 129 and sides 143A and 143B extend outwardly of, and are retained by, shoulder elements 147A and 147B (only shoulder 147B is illustrated in FIG. 1). Bracket 112 thereby is retained on mop head 122. As is illustrated in FIG. 2, as handle 104 is slid distally along handle 100, rod 106 causes bracket 112 to press downwardly against an upper surface of mop head 122 causing hinges 135A and 135B to flex downwardly (shown in phantom in FIG. 2), thereby wringing sponge 126.

The mop in one embodiment also includes a cover 114 which mates with, and is retained against, an upper surface of mop head 122. Cover 114 includes an opening 116 through which handle 100 extends. Cover 114 includes a front surface area 132 to which a brush may be attached. Brush may be attached by any suitable means such as adhesive, hook and loop fastener, etc.

Cover 114 has an underneath surface which mates with the upper surface of mop head 122. Cover 114 is retained on mop head 122 by the extension of handle 100 through opening 116 and also by the mating of a front shoulder portion 147 (on underneath surface of cover 114) with lip 149 of squeegee receiving member 127.

Figure 6:
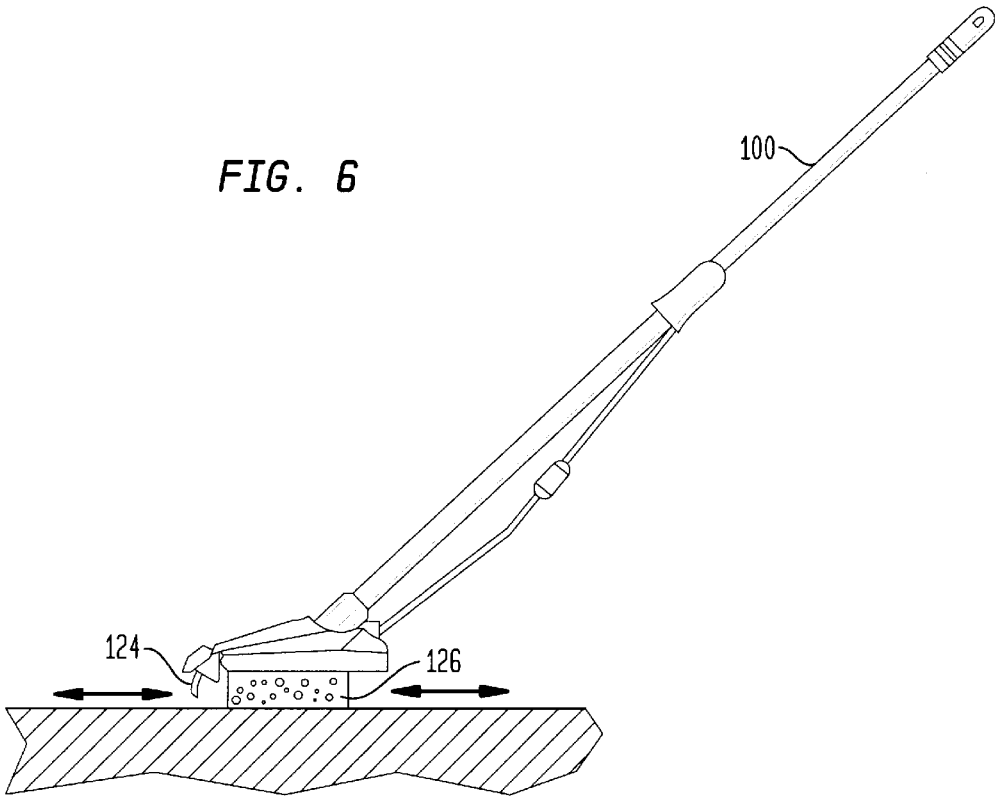
FIG. 6 is a side view of the mop of FIG. 1 illustrating use of the mop in the cleaning position.
Figure 7:
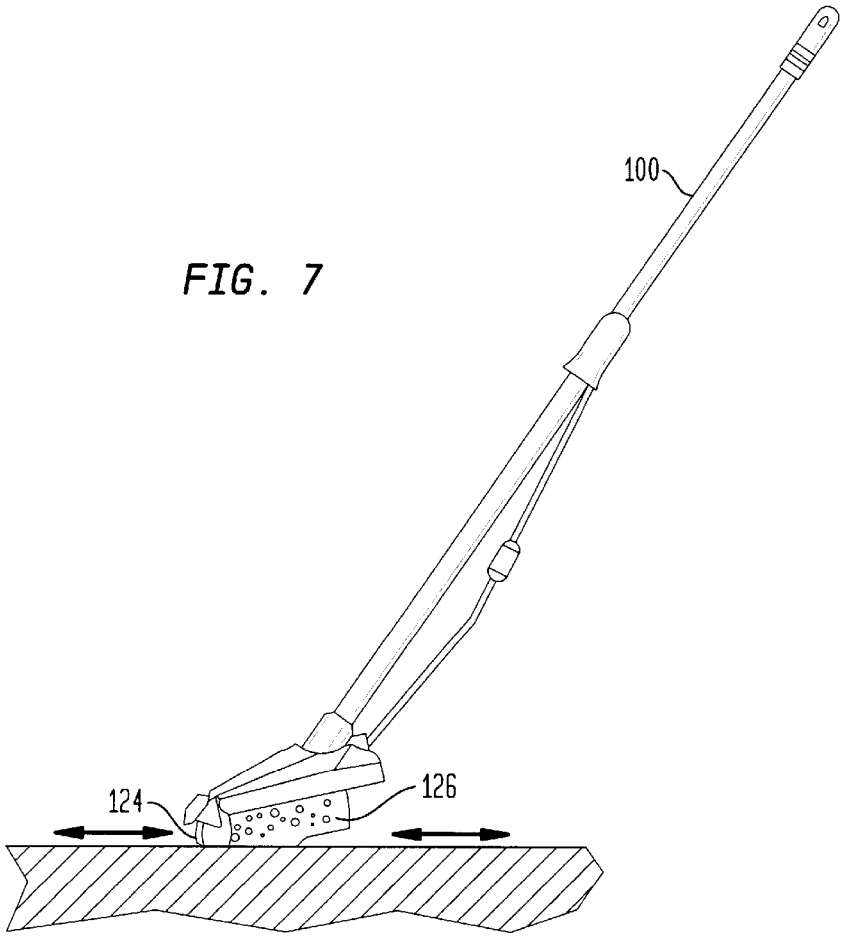
FIG. 7 is a side view of the mop of FIG. 1 illustrating use of the mop in the drying position.

The mop of this preferred embodiment thus enables cleaning by the mop with sponge 126 contacting the surface to be cleaned (as shown in FIG. 6) as well as the drying of the surface with both sponge 126 and squeegee 124 contacting the surface (as shown in FIG. 7). Between cleaning (FIG. 6 position) and drying (FIG. 7 position), the sponge can be wrung out with the sponge element itself. The positioning of the sponge with respect to the squeegee, the distance between the two, the angle of the squeegee with respect to the front surface of the sponge, the distance of the wiping surface of the squeegee with respect to the surface to be cleaned when the bottom surface of the sponge is in contact with the surface to be cleaned, and the positioning of the handle 100 with respect to the mop head, all are selected specifically to accomplish significant wicking and absorption of the sponge during drying, and to enable mopping and drying that is ergonomically comfortable to the user. In addition, the mop can be used for cleaning, then can be wrung out using an integral wringing mechanism, then can be used for drying, simply by tilting the angle of the handle. Thus mopping and drying can be accomplished easily and effectively with the mop of the present invention.

While the backing plate of the present invention has been described with respect to a mop that includes a butterfly design, a sponge wringing mechanism, and an attached squeegee, the invention is not so limited. The backing plate of the present invention may be used with any mop head design.

Having thus described at least one illustrative embodiment of the invention, various alterations, modifications and improvements will readily occur to those skilled in the art. Such alterations, modifications and improvements are intended to be within the spirit and scope of the invention. Accordingly, the foregoing description is by way of example only and is not intended as limiting. The invention is limited only as defined in the following claims and the equivalents thereto.

What is claimed is:

1. A mop comprising:

an elongate handle;

a mop head attached to one end of the handle; and a backing plate, to which a floor cleaning element is attached, removably attached to the mop head;

wherein the backing plate includes at least one male attachment member on a first edge of the backing plate and at least one female attachment member on a second edge of the backing plate, the first edge opposite the second edge, the male attachment member removably attached to a corresponding female attachment member on the mop head, and the female attachment member removably attached to a corresponding male attachment member on the mop head;

wherein an upper surface of the backing plate includes protrusions that fit within corresponding compartments on an underneath surface of the mop head;

wherein each protrusion is T-shaped.

2. A mop comprising:

an elongate handle;

a mop head attached to one end of the handle; and a backing plate to which a floor cleaning element is attached, removably attached to the mop head;

wherein the backing plate includes at least one male attachment member on a first edge of the backing plate and at least one female attachment member on a second edge of the backing plate, the male attachment member removably attached to a corresponding female attachment member on the mop head, and the female attachment member removably attached to a corresponding male attachment member on the mop head;

wherein the backing plate includes two side members connected by a plurality of spaced, flexible finger members.

3. The mop as claimed in claim 2 wherein the side member may flex about the fingers toward one another during wringing of the cleaning element.

4. A plate that removably attaches a sponge to a mop head comprising:

a top surface, that removably attaches to a mop head, and a bottom surface, to which the sponge is attached;

at least one male attachment member on a first edge of the top surface for removable attachment to a corresponding female member on the mop head; and at least one female attachment member on a second edge of the top surface, opposite the first edge, for removable attachment to a corresponding male member on the mop head;

further including a plurality of protrusions on the top surface of the backing plate, that removably fit within corresponding compartments on an underneath surface of the mop head;

wherein each protrusion is T-shaped.

5. A plate that removably attaches a sponge to a mop head comprising:

a top surface, that removably attaches to a mop head, and a bottom surface, to which the sponge is attached;

at least one male attachment member on a first edge of the top surface for removable attachment to a corresponding female member on the mop head; and at least one female attachment member on a second edge of the top surface, for removable attachment to a corresponding male member on the mop head;

wherein the backing plate includes two side members connected by a plurality of flexible, spaced finger members.

* * * * *